US005224297A

United States Patent [19]

Watkins

[11] Patent Number: 5,224,297

[45] Date of Patent: Jul. 6, 1993

[54] SLIDING DOOR AND LATCHING/LOCKING ASSEMBLY

[75] Inventor: Richard D. Watkins, Gloversville, N.Y.

[73] Assignee: Nelson A. Taylor Co., Inc., Gloversville, N.Y.

[21] Appl. No.: 712,543

[22] Filed: Jun. 10, 1991

[51] Int. Cl.[5] ..... E05B 55/00

[52] U.S. Cl. ..... 49/449; 49/40; 49/411; 49/426; 49/460; 70/210; 70/489; 292/210; 292/DIG. 46

[58] Field of Search ..... 49/449, 40, 349, 460, 49/425, 426, 411, 141; 70/210, 485, 484, 489, 470, 211; 292/DIG. 46, 210

[56] References Cited

U.S. PATENT DOCUMENTS

| | | | |
|---|---|---|---|
| 1,639,878 | 8/1927 | Bentrott . | |
| 2,251,138 | 7/1941 | Knight | 292/128 |
| 2,521,111 | 9/1950 | Ylinen | 70/485 |
| 2,523,727 | 9/1950 | Sevison | 292/128 |
| 2,646,949 | 7/1953 | Saulnier | 49/425 X |
| 2,769,330 | 11/1956 | O'Connell | 70/485 X |
| 2,784,993 | 3/1957 | Collar | 70/485 X |
| 2,917,915 | 12/1959 | Rainman | 70/210 X |
| 2,953,824 | 9/1960 | Minick | 20/11 |
| 3,050,322 | 8/1962 | Miller | 292/114 |
| 3,078,524 | 2/1963 | Minick | 20/52 |
| 3,161,923 | 12/1964 | Crain | 20/52 |
| 3,220,759 | 11/1965 | Miller | 292/120 |
| 3,881,758 | 5/1975 | Gross | 292/87 |
| 3,884,056 | 5/1975 | East et al. | 292/210 X |
| 4,021,073 | 5/1977 | Manning | 296/137 |
| 4,138,869 | 2/1979 | Pelcin | 70/210 X |
| 4,833,829 | 5/1989 | Wilson | 49/426 |

*Primary Examiner*—Philip C. Kannan
*Attorney, Agent, or Firm*—Nixon & Vanderhye

[57] ABSTRACT

A latching and locking sliding door construction includes an elongated handle pivotally mounted to the door, the handle including a latch member located along one edge of the handle, the latch member adapted to cooperate with a catch member fixed to a portion of the entranceway. A key lock assembly is mounted in the door and adapted to lock the door in a closed position by preventing rotation of the handle and thereby disengagement of the latch member from the catch member. The lock assembly includes a manually actuable locking cam mounted on the other side of the door which permits the door to be locked and unlocked from inside the cabin independent of the rotational position of the key lock.

18 Claims, 7 Drawing Sheets

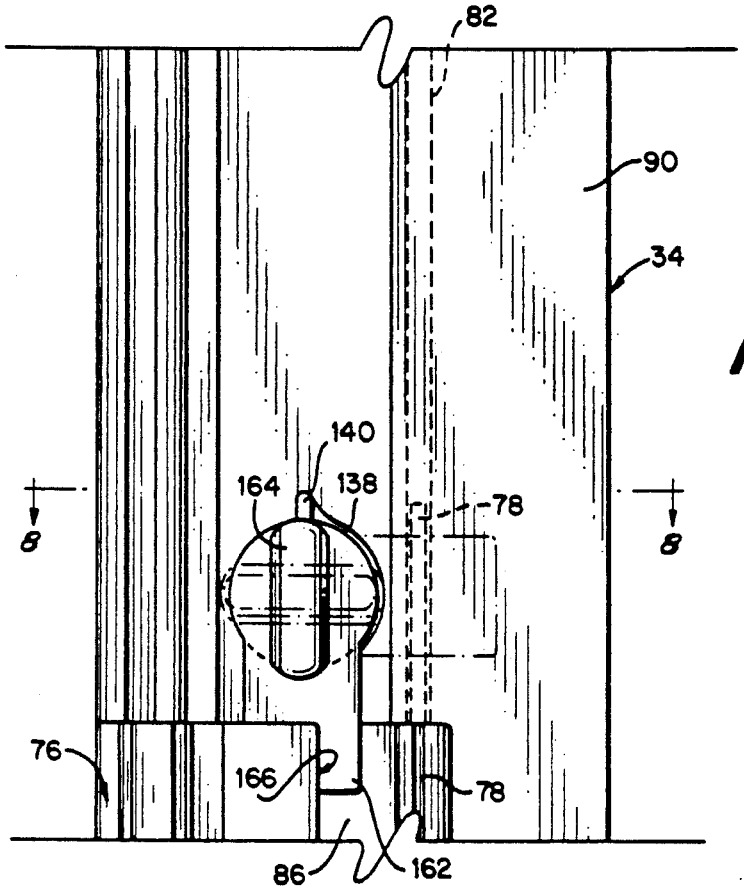
FIG. 4
FIG. 5
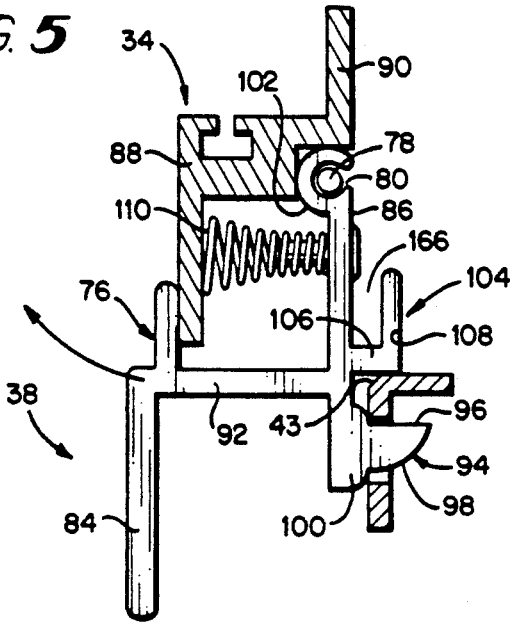
FIG. 5A
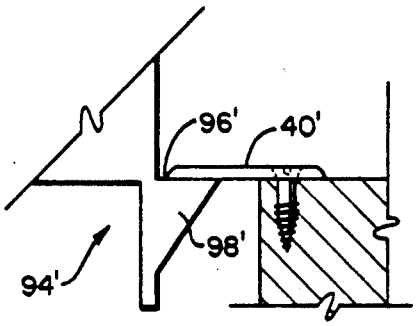

FIG. 7
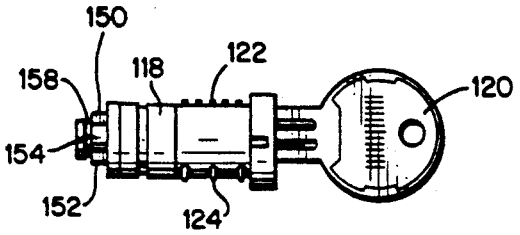
FIG. 8
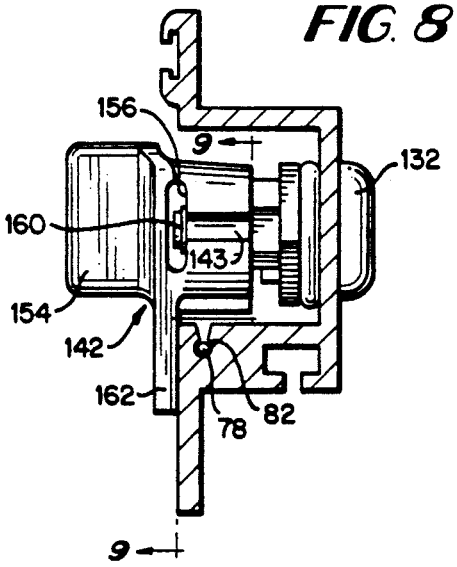
FIG. 9
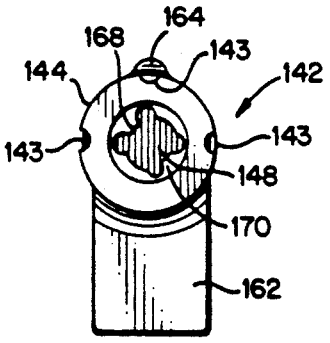
FIG. 10
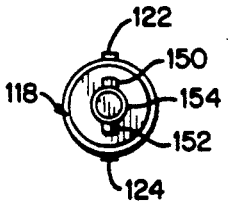
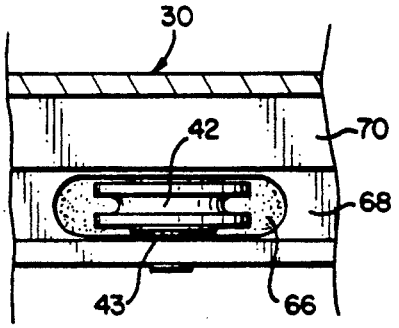
FIG. 11

SLIDING DOOR AND LATCHING/LOCKING ASSEMBLY

FIELD OF THE INVENTION

This invention relates generally to sliding door constructions and associated latching and locking assemblies therefor, and, more particularly, to a sliding door construction and associated latching and locking assembly for providing access to a boat cabin.

BACKGROUND AND SUMMARY OF THE INVENTION

Sliding doors are typically referred to in marine applications as hip doors, companionway doors, cutty doors, etc. Such doors typically have angled or curved configurations from top to bottom and typically permit access to cabin areas in the lower deck portion of a boat.

Sliding doors, of course, have long been utilized in a number of different environments, including residential homes, greenhouses, van type vehicles, aircraft cockpits, observatory domes, and the like. A sliding door construction specifically for marine use is disclosed in U.S. Pat. No. 4,833,829. An earlier example of a sliding access door in a life saving craft for use on seagoing vessels is disclosed in U.K. Patent 460,750.

The use of a sliding door construction in marine applications is advantageous in that it eliminates previously used swinging door constructions which required constant maintenance of hinges and other moving parts, and which were difficult to seal against the elements in their closed position.

One disadvantage of utilizing conventional sliding door constructions for marine use is the inability to effect independent latching/unlatching and locking/unlocking of the door from both outside and inside the cabin.

The present invention provides a sliding door construction particularly adapted for marine use which provides a unique lock and latch assembly which enables locking and unlocking from outside the cabin through the use of a commercially available key lock, while permitting keyless locking and unlocking from inside the cabin independent of the rotational position of the key lock cylinder. The construction also allows latching and unlatching of the door from either side of the door when the assembly is unlocked.

In one exemplary embodiment of the invention, elongated tracks are secured to a cabin entranceway adjacent upper and lower edges of the entranceway on the exterior side of the cabin, for supporting a cabin door for rolling movement between open and closed positions.

In this first exemplary embodiment, the sliding door is itself framed by upper and lower horizontal members along with a pair of curved side wall frame members connecting the upper and lower frame members. A plurality of rollers are rotatably secured to inside surfaces of the upper and lower door frame members, the rollers being configured to mate with rails provided within the track assemblies fixed to the upper and lower "frames" of the cabin entranceway. In this way, the door is securely supported by the track assemblies, and is prevented from separating therefrom by the configuration of the rollers and rails.

The handle and latching/locking assembly in an exemplary embodiment of the invention includes a pivotally mounted handle, preferably an extruded piece of aluminum or other suitable material, secured within a cutout portion of one of the side wall frame members of the door by a pair of hinge pins extending vertically through a slot provided in the handle and received within a continuous slot (interrupted by the cutout portion) provided in the extruded door frame member. In this exemplary embodiment, the handle member is provided on its rearward face (facing the cabin interior), with an elongated latch adapted to engage and be received in an elongated slot provided in a catch member fixed to a cabin entranceway perimeter. In an alternative arrangement, the catch member comprises a simple flat plate, and the elongated latch is adapted to ride over and "lock" behind the catch plate. In both arrangements, the handle member is spring biased to a closed position so that upon shutting of the door, the latch will be resiliently urged into full engagement with the slot in the catch member (or behind the catch plate in the alternative arrangement). The door can be unlatched simply by pulling the handle outwardly away from the catch, thereby permitting sliding of the door to an open position. In this way, the door can be latched and unlatched from both sides when the assembly is unlocked.

A key lock assembly is mounted in the door side wall frame, just above or below the handle, with key access on the exterior side (facing away from the cabin interior) of the door. The key lock cylinder/barrel assembly is a commercially available item and includes a conventional cylinder and barrel arrangement wherein two axial rows of locking tabs extend radially away from the cylinder on diametrically opposite sides thereof, and which are received in corresponding axial grooves provided in the barrel. Upon insertion of the key, the two rows of locking tabs retract into the cylinder to thereby permit rotation of the cylinder relative to the barrel. The key lock assembly also includes a locking cam on the interior side of the door side wall frame which is secured to the free end of the cylinder and which is rotatable into engagement with a slot provided on a rearward face of the handle assembly (via rotation of the key) to thereby prevent the handle from outward (or opening) pivotal movement which would otherwise disengage the latch from the slot in the catch member.

At the same time, however, the locking cam is provided with a manually grippable knob which permits the locking cam to be rotated into and out of a locking position regardless of the rotational position of the key lock cylinder. In other words, even if the key has been utilized to lock (or unlock) the cabin door from the outside, a person within the cabin may unlock (or lock) the door simply by rotating the knob to rotate the locking flange out of (or into) engagement with the slot provided on the rear face of the handle, which, in turn, permits (or prevents) outward pivoting movement of the handle to disengage the latch member from the slot in the catch member. This is possible because of a cam slot/cam projection arrangement between the key cylinder and a cooperating locking cam member which permits 90° freedom of movement of the locking cam independent of the rotational position of the key cylinder. This 90° freedom of movement is a characteristic of the commercially available key cylinder utilized in this invention, although other aspects of the locking cam member have been designed specifically for the door constructions disclosed herein.

In another exemplary embodiment of the invention, the sliding door itself is unframed, and the roller assemblies are attached directly to, for example, the relatively thick plexiglass panels which form the doors. At the same time, the handle and latching/locking assembly is pivotally mounted to an extrusion which, in turn, is secured directly to the plexiglass panel. In this alternative embodiment, the key lock may be mounted through the extrusion.

Thus, in one exemplary embodiment of the invention, there is provided in combination with a door slidable on tracks extending across an entranceway having a perimeter, a latching and locking mechanism comprising an elongated handle pivotally mounted on the door, the handle including a latch member located along one edge of the handle, the latch member adapted to cooperate with a catch member fixed to a portion of the entranceway perimeter, and a key lock assembly mounted the door and adapted to lock the door in a closed position by preventing disengagement of the latch member from the catch member.

In another aspect, the invention provides a sliding door construction for a cabin entranceway of a boat comprising: a door having upper, lower and a pair of side edges; a plurality of rollers mounted to inside surfaces of the door adjacent the upper and lower edges, respectively; the plurality of rollers adapted for rolling engagement with upper and lower tracks secured along upper and lower portions, respectively of the entranceway; a handle and lock assembly secured along one of said side edges of the door, the handle and lock assembly including a handle pivotally mounted for movement between open and closed positions, the handle including an elongated latch member adapted to cooperate with an elongated catch member secured to the cabin entranceway; the handle and lock assembly further comprising a key lock assembly mounted in the door adjacent the handle, the key lock assembly operatively associated with a locking cam for movement into and out of a slot provided in the handle from outside the cabin upon rotation of a key inserted within the key lock, and wherein the locking cam is rotatable from within the cabin into and out of the slot provided on the handle independent of the key lock cylinder position.

Additional objects and advantages of the present invention will be apparent from the detailed description which follows.

BRIEF DESCRIPTION OF THE DRAWINGS

FIG. 4 is a partial rearward view of the handle and lock assembly illustrated in FIG. 1, with the locking flange shown in a locked position;

FIG. 5 is a partial cross sectional view in plan taken along the line 5—5 of FIG. 1 but with the door in a closed position;

FIG. 5A is a partial cross sectional view similar to FIG. 5 but showing an alternative latch/catch arrangement;

FIG. 7 is a side view of the key and key cylinder illustrated in FIG. 6;

FIG. 8 is a partial cross sectional view in plan of the lock assembly secured to the door frame and taken along line 8—8 in FIG. 4 but with the manual locking flange rotated 90° to an unlocked position for purposes of clarity;

FIG. 9 is an end view of the locking cam element of the lock assembly taken along the line 9—9 of FIG. 8;

FIG. 10 is an end view of the key lock cylinder illustrated in FIG. 7, but with the key removed;

FIG. 11 is a partial sectional view in plan of a door frame and roller of the type shown in FIG. 2;

FIG. 13 is a side profile of an unframed sliding door construction in accordance with still another embodiment of the invention.

DETAILED DESCRIPTION OF THE DRAWINGS

Figure 1:
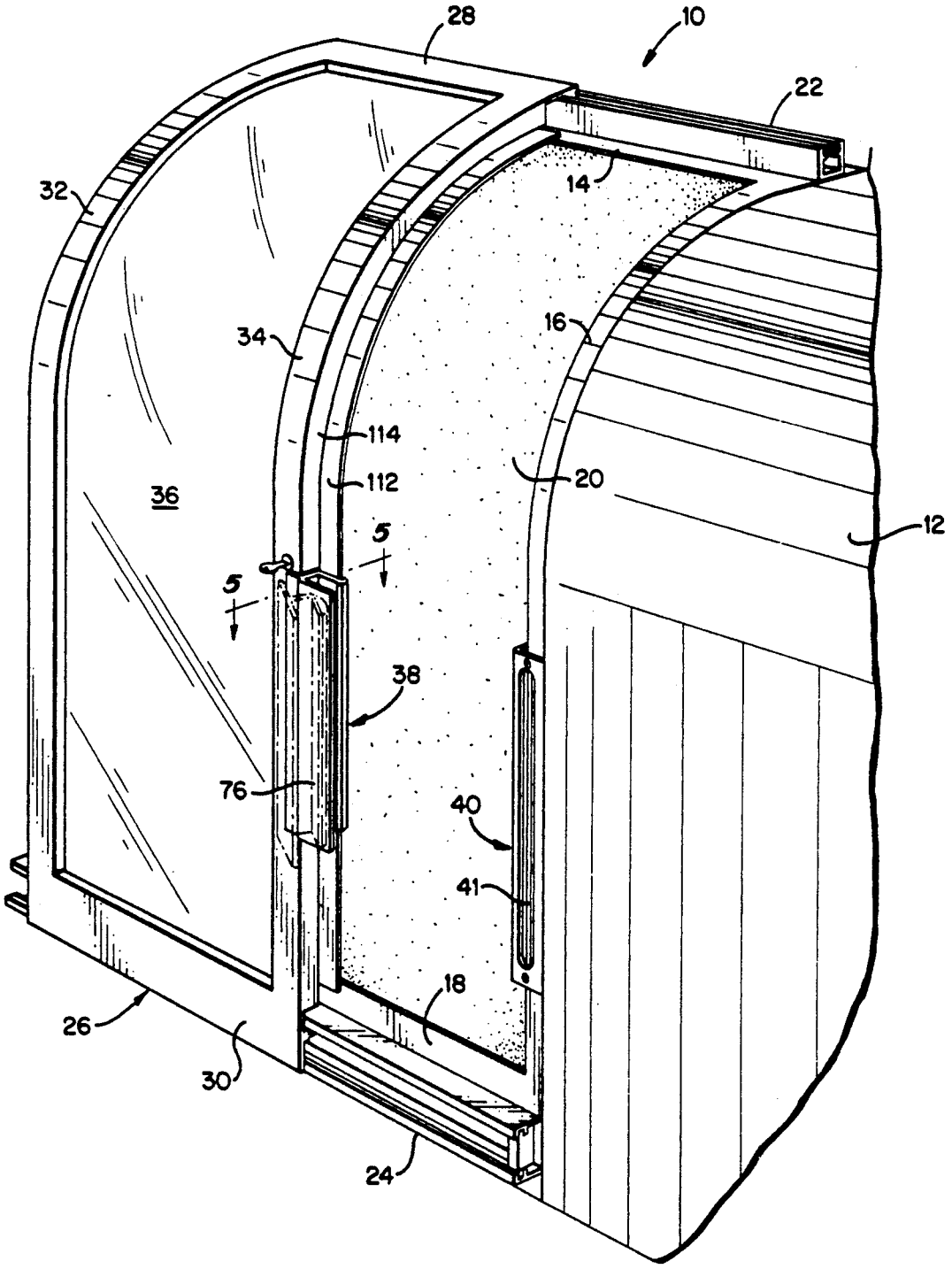
FIG. 1 is a partial perspective view of a framed sliding door construction for a boat cabin in accordance with an exemplary embodiment of the invention.

With reference now to FIG. 1, a cabin door assembly 10 for a boat is illustrated in conjunction with a partially shown cabin 12. A cabin entranceway 20 is defined by an upper horizontal frame 14, a curved side frame 16 and a lower horizontal frame 18 (a second curved side frame is not shown but is otherwise similar to side edge 16). The entranceway may be framed (as shown in the drawings) by metal, such as extruded aluminum, or by other materials such as wood or rigid plastic. It will be appreciated, however, that no separate frame members are required for the entranceway, in which case, reference numerals 14, 16 and 18 can be considered as referring to perimetral edges of the cabin entranceway. In any event, the construction of the cabin and entranceway per se form no part of this invention.

A first, substantially C-shaped track 22 is secured along and to the upper horizontal frame member 14, the track opening facing away from the frame member 14. Similarly, a second, substantially C-shaped track 24 is secured along and to the lower horizontal frame member 18, the track opening also facing away from the frame member. These tracks may also be constructed of extruded aluminum, rigid plastic or other suitable material.

As shown in the FIG. 1 embodiment, the cabin door 26 includes upper and lower horizontal frame portions 28, 30 and curved frame portions 32, 34 extending between the upper and lower portions 28, 30. As in the case of the cabin opening framework, the door frame portions are typically extruded aluminum but could also be constructed of a rigid, durable plastic or other suitable material. A glass, plexiglass or other panel 36 is fitted within the frame portions 28, 30, 32 and 34.

The curvature of the door between its upper and lower ends, as shown in FIG. 1 is slightly less than 90°, with a substantially vertical portion in the lower half of the door. This shape is merely exemplary, however, it being understood that the door may be planar, slightly curved, substantially curved, or formed as two planar portions fixed together at virtually any occluded angle from 0° to about 90° (see, for example, the framed doors in FIGS. 12 and 13).

The sliding door 26 is provided with a handle and lock assembly 38 which cooperates with a catch member 40 (and elongated slot 41 therein) fixed to the vertical cabin frame member 16, as described in further detail below.

Figure 2:
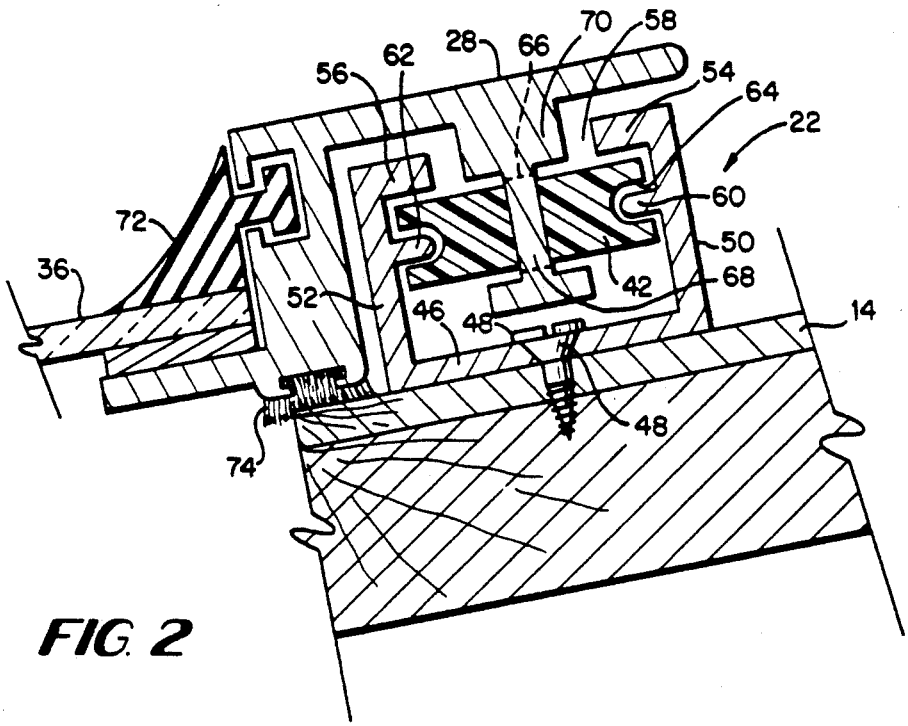
FIG. 2 is a cross sectional elevation of an upper track and roller assembly of the door construction illustrated in FIG. 1.
Figure 3:
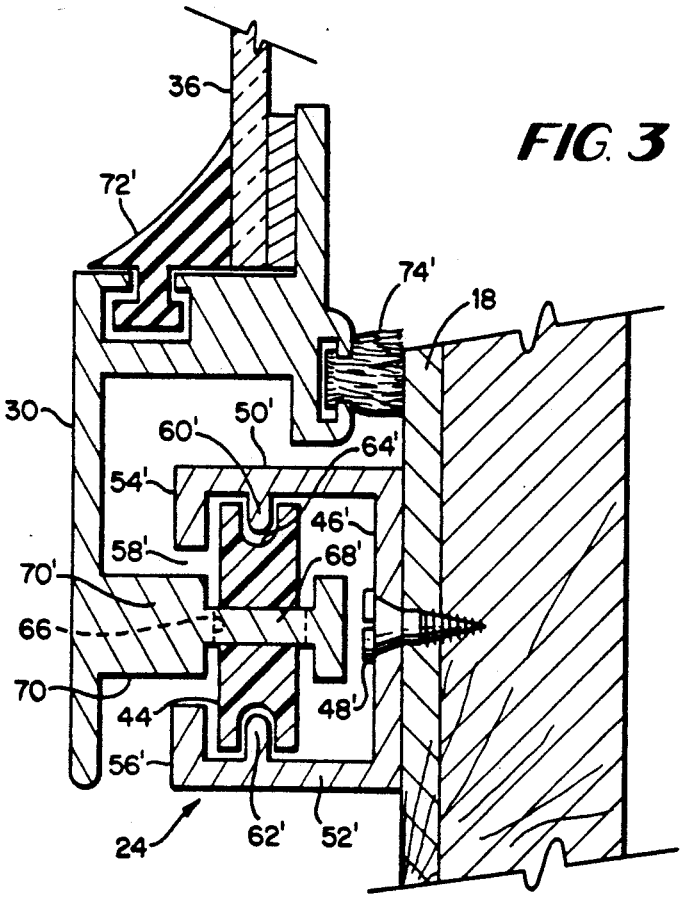
FIG. 3 is a partial cross sectional elevation of a lower track and roller assembly illustrated in FIG. 1.
Figure 6:
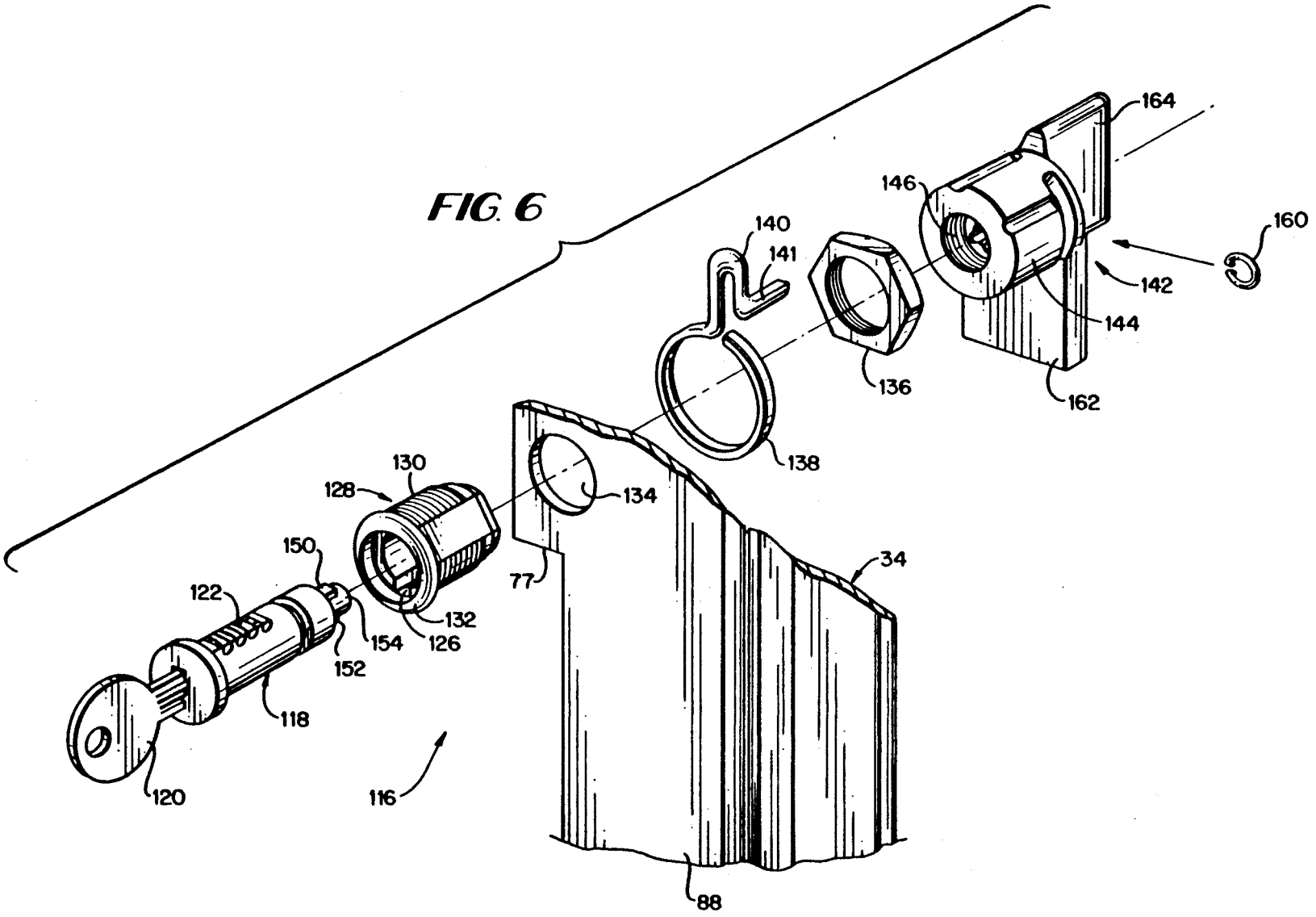
FIG. 6 is an exploded perspective view of the key lock assembly in accordance with an exemplary embodiment of the invention.

Turning to FIGS. 2 and 3, the fixed tracks 22 and 24 are shown in cooperation with rollers 42, 44, respectively, the rollers being fixed to the door frame members 28, 30 so that the door 26 is supported for rolling movement within the confines of tracks 22, 24 to enable easy opening/closing movement of the door. With reference specifically to FIG. 2, the upper track member 22 includes a base portion 46 adapted to engage the cabin frame member 14 and to be fastened thereto by means of screws 48 or the like. Parallel leg portions 50, 52 extend away from the base portion and have flange portions 54, 56, at their free ends, respectively, which face each other and which define an opening 58 through which the roller 42 projects from the door frame member 28. Leg portions 50, 52 include projections 60, 62, respectively, which extend parallel to flange portions 54, 56 and which are received in a peripheral groove 64 of the roller to thereby provide a rail for the roller which insures that the roller will be confined within the track 22.

As best seen in FIG. 11, roller 42 is mounted within an elongated aperture 66, provided in a reduced thickness portion 68 of an inwardly directed flange 70 which extends the length of the frame member 28. Roller 42 is mounted on an axle 43 secured on either side of the aperture 66 in any suitable manner, and it will be understood that there will be two or more rollers 42 mounted in similar apertures along the length of the frame 28 which support the door 26 for rolling engagement with the track 22.

Rollers 42 are preferably constructed of a hard plastic material, but other material such as metal may also be employed.

The lower track assembly 24, and the lower door frame member 30 is identical (other than its orientation with respect to vertical) to the upper track/roller assembly, and similar reference numerals, with prime designations added, are used to denote similar elements, and no further description is necessary. It is sufficient to note that the door is supported at its upper and lower ends for easy rolling movement between open and closed positions, and is prevented by the roller/track configuration from separating from the track assemblies 22, 24.

Conventional glazing 72, 72' is applied along the interface of panel 36 with the door frame members, and weatherstripping 74, 74' is applied between the door frame members 28, 30 and cabin frame members 14, 18.

With reference now to FIGS. 1, 4, 5 and 6, the handle and lock assembly 38 comprises a pivotally mounted handle 76 which comprises an extruded strip of aluminum (or other suitable material), secured within a C-shaped cut-out portion 77 (see FIG. 6) of door frame member 34 by means of a pair of hinge or pivot pins 78 extending vertically through a part-circle slot 80 (FIG. 5) provided in the handle 76 and received within a continuous slot (except for the cut-out portion) 82 provided in the door frame member 34 (one end of one of the pins is shown in phantom in slot 82 in FIG. 4).

As best seen in FIG. 5, the handle member 76 includes a forward or outward facing (relative to the boat cabin interior) stepped planar portion 84 and a substantially parallel rearward or inward facing planar portion 86 which extend substantially parallel to surfaces 88, 90 of frame member 34. In fact, portion 86 is substantially co-planar with surface 90, while planar portion 84 lies adjacent, and in surface engagement with surface 88.

Forward and rearward planar portions 84 and 86 are interconnected by a cross-piece 92 which extends perpendicularly therebetween. To one side of cross-piece 92, rearward portion 86 is provided with an elongated latch member 94, having intersecting straight and curved surfaces 96, 98, respectively, extending from a thickened portion 100 and projecting rearwardly (toward the cabin interior). The latch member 94 extends along the full length of the handle 76. To the other side of cross-piece 92, planar portion 86 extends beyond planar portion 84 to a C-shaped hinge 102 defining the part circle slot 80 which receives the pivot pins 78. Intermediate the hinge member 102 and the latch 94, there is a right angle, rearward extension 104 defined by a rearward projection 106 and a flange 108 extending toward the hinge member 102.

As best understood from FIGS. 1 and 5, when the handle is in the normal closed position (spring biased by any suitable conventional means such as coil spring 110), planar portion 86 will lie flush with surface 90 and will, in effect, form an extension of the rearward flange 112 of the door frame member 34. At the same time, cross-piece 92 will lie substantially flush with surface 114 of the same frame member. When the door is to be closed, handle 76 may be pivoted outwardly about pins 78 to an open position and, after the door is slidably moved along track assemblies 22, 24 to a closed position, the handle 76 may be released so that latch 94 will be received within the elongated slot 41 of the catch 40, and held there under the biasing action of spring 110. It will be appreciated, however, that the door may also be closed without first moving the handle 76 to an open position. Thus, by merely sliding the door closed, the curved surface 98 of the latch 94 will ride over the chamferred edge 43 of the catch 40 until resiliently urged into the slot 41 by the action of spring 110. To open the door 26, handle 76 is simply pivoted away from catch 40, and the door pulled sideways to an open position.

FIG. 5A illustrates an alternative latch/catch arrangement for use with either framed or unframed doors. In this instance, where like numerals with prime designations are used for components corresponding generally to those of FIG. 5, the catch member 40' comprises a flat plate secured to an edge of the cabin entranceway by means of screws extending through slots in the catch (the slots permit adjustment of the plate relative to the latch). The latch 94' is angularly shaped, including intersecting surfaces 96', 98', the latter serving as a cam or ramp surface which rides over the plate 40' when the door is moved to a closed position, and "locks" behind surface 96', engaging the back side of catch plate 40'.

It is an additional feature of this invention to provide a key lock for the door 26 as described further below. The key lock assembly 116 is best seen in exploded form in FIG. 6. A conventional, rotatable lock cylinder 118 is employed with a conventional key 120. One suitable cylinder/key lock is sold by the Eberhard Corp. (Model No. P/N 16404), the internal construction of which need not be described in detail here. This lock is designed to cooperate with a second component which is designed to permit the 90° freedom of movement described above. For purposes of this invention, the second component has been customized for the particular application here, as further described below. In other words, the key lock and the 90° freedom of movement feature are not new to this invention. Applicant has, however, provided a new "locking cam" which incorporates the 90° freedom of movement feature so as to adapt the commercially available key lock to the marine application of this invention.

The cylinder 118 is provided with two axial rows of spring biased locking tabs 122, 124 located at diametrically opposed positions about the circumference of the cylinder. These tabs are adapted to be received within diametrically opposed interior grooves 126 (only one shown) formed within a barrel 128, exteriorly threaded at 130, which slidably receives the cylinder 118. The barrel 128 and cylinder 118 project through a hole 134 in the door frame member 34, and are held in clamped relationship thereto by means of a nut 136 in cooperation with the enlarged head 132 of the barrel 128. Sandwiched between the door frame and nut 136 is a substantially annular spring ring 138 provided with a rearward loop-like extension 140, which terminates in an axial projection 141, the purpose of which will be described below.

A locking cam 142 has a cylindrical portion 144, bored at 146 to receive the rearward portion of cylinder 118. With reference to FIG. 9, it may be seen that a rearward wall of the cylindrical portion 144 is machined to form a cam recess 148 which is adapted to receive a pair of radially opposed cam projections 150, 152 fixed to a reduced diameter tip 154 of the cylinder 118.

A slotted aperture 156 (see FIG. 8) is cut radially through the base of cylindrical portion 144 and is in communication with recess 148 and bore 146. When assembled, an annular groove 158 (see FIG. 7) at the forward tip 122 of cylinder 118 lies within the aperture 156 to thereby permit a C-shaped retaining ring 160 to be resiliently engaged within the groove to thereby prevent axial sliding movement of the cylinder 118 relative to the locking cam 142 so that the cylinder 118 cannot be removed from the lock barrel 34 unless the retaining ring 160 is first removed.

The locking cam 142 also includes a locking flange 162 extending diametrically away from a center axis of the cylindrical portion 144, and a rearwardly projecting knob 164, the latter designed for manual rotation to lock and unlock the door from within the cabin as explained further below.

With reference again to FIGS. 4 and 5, it may be seen that the right angle extension 104 of member 86 forms a slot 166 extending along the rearward face of the handle 76. With specific reference to FIG. 4, it will be appreciated that locking flange 162 may be rotated into or out of the slot 166 upon insertion of the key 120 from outside the cabin. Specifically, upon insertion of the key 120 into cylinder 118, the rows 122, 124 of the locking tabs will retract into the cylinder 118, thereby permitting rotation of the latter relative to the barrel 128. Upon rotation of the key 120 and cylinder 118, the radial projections 150, 152 will rotate until they engage inwardly projecting portions 168, 170 of the cam recess 148 and therefore cause rotation of the locking flange 162 into or out of the slot 166. The rotational movement of the locking latch 162 is resisted or controlled by the spring-biasing action of the extension 141 of spring ring 138 which frictionally engages the peripheral surface of the cylindrical portion 144 of the locking cam 142. Grooves or detents 143 are provided at 90° intervals about the circumference of cylindrical portion 144 and are adapted to receive the extension 141 upon rotation of the locking cam 142, either by key 120 or by knob 164, to thereby hold the locking cam 142 in either its locked or unlocked positions.

Regardless of the position of key cylinder 118, 90° freedom of motion for the locking cam 142 is provided in either of two opposite directions by the configuration of slot 166 and the diametrically opposed projections 168, 170. In other words, radial projections 150, 152 of cylinder 118 and the projections 168, 170 of the cam recess 148 must be in mutual engagement before rotation of the cylinder 118 will cause rotation of the locking latch 162. At the same time, the arrangement of cam recess 148 and projections 168, 170 will permit the knob 164 (and locking flange 162) to be rotated independently of the rotational position of cylinder 118 to thereby permit independent locking and unlocking from inside the cabin. As shown in solid line configuration in FIG. 4, the locking flange 162 has been rotated to a locking position, with flange 162 within the slot 166, thereby preventing pivoting movement of the handle 76 about the pins 78. In the open position, shown in phantom in FIG. 4, the flange 162 is rotated away from the slot 166 to permit pivoting movement of the handle, and thus disengagement of the latch member 94 from the slot 41. Thus, a person inside the cabin can lock or unlock the cabin door without a key via manual rotation of the knob 164, regardless of whether the door has been locked or unlocked from outside the cabin via key 20.

The above described construction thus provides a unique and easy-to-use latching and locking arrangement which is particularly useful in sliding doors utilized on boats, but which is applicable in other sliding door applications as well, as will be appreciated by those skilled in the art.

Figure 12:
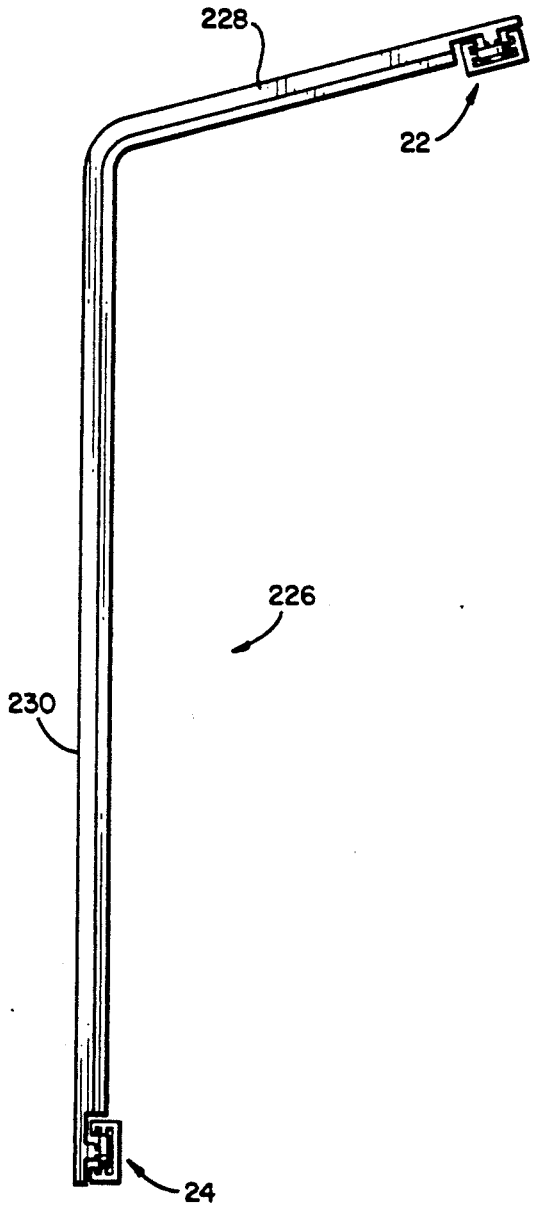
FIG. 12 is a side profile of a framed door construction in accordance with an alternative embodiment of the invention.
Figure 13:
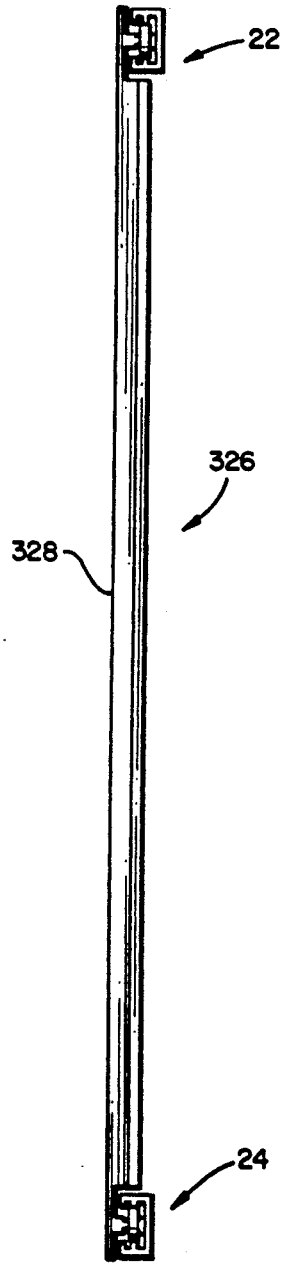
FIG. 13 is a side profile of a framed sliding door construction in accordance with still another embodiment of the invention.
Figure 12A:
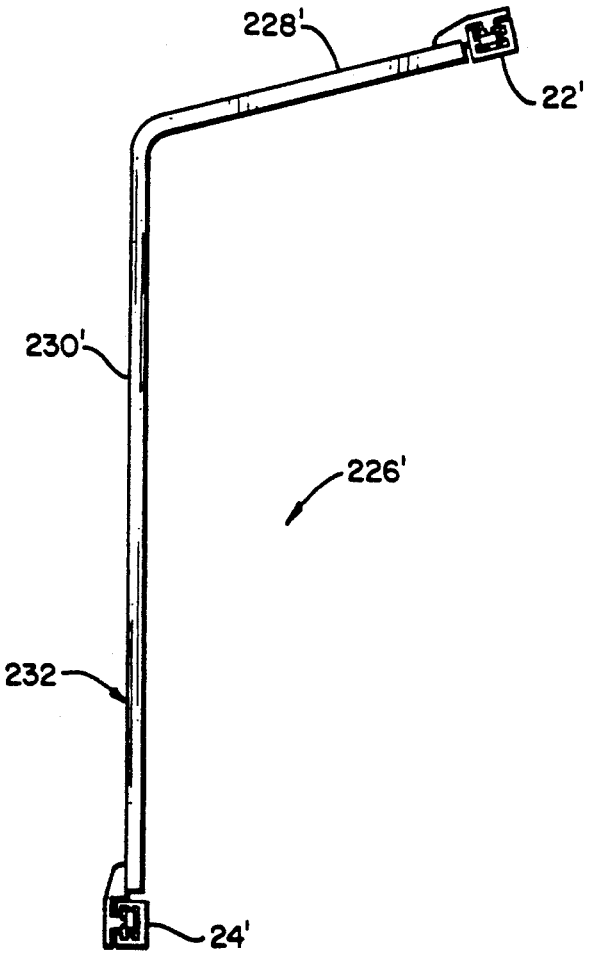
FIG. 12A is a side profile of an unframed door construction in accordance with an alternative embodiment of the invention.
Figure 13A:
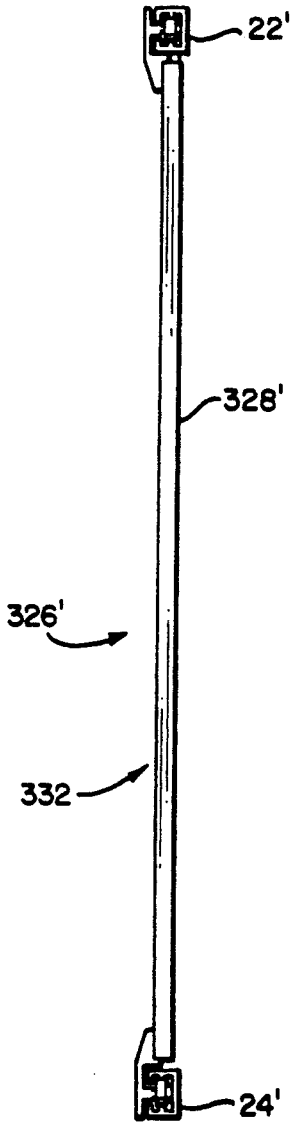

As noted hereinabove, FIGS. 12 and 13 illustrate framed sliding doors in accordance with other embodiments of the invention. In FIG. 12, the door 226 is formed with planar portions 228 and 230 which extend angularly with respect to each other, while in FIG. 13, the door 326 has a uniformly planar portion 328 from top to bottom. Otherwise, the doors, tracks, and locking mechanism are identical to those described above. FIGS. 12A and 13A illustrate unframed doors 226', 326' which are otherwise similar in shape to the doors shown in FIGS. 12 and 13, respectively. In these unframed constructions, where numerals corresponding to those in FIGS. 12 and 13 are used with prime designations, the roller assemblies 22', 24' are secured directly to the door panels 232, 332, respectively. In these unframed doors, and as described previously, the handle and latching assembly is pivotally mounted to an extrusion somewhat similar to frame 34 but having a length only slightly greater than handle 76. This extrusion is affixed within a C-shaped opening cut in the door panel, and the locking/latching assembly otherwise functions in the same manner as the framed door version.

It will be appreciated that the door profiles shown in FIGS. 12, 12A, 13 and 13A are exemplary only, and various other profiles are within the scope of this invention. Moreover, the orientation of the cabin entranceway, i.e., whether in a vertical, horizontal or inclined cabin wall, and therefore the orientation of the door itself, may be varied in accordance with the boat design and thus, references to "vertical" or "horizontal" herein are also exemplary only.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In combination with a sliding door, a latching and locking mechanism comprising:

an elongated handle pivotally mounted on the door, said handle including a latch member located along one edge of the handle, said latch member adapted to cooperate with a catch member fixed to a portion of an entranceway having a perimeter; and a key lock assembly mounted in said door and adapted to lock the door in a closed position by preventing disengagement of said latch member from said catch member; wherein said door includes a frame comprising upper, lower and a pair of side frame members, and wherein said key lock assembly is mounted in one of said side frame members, said one of said side frame members and said handle having substantially complimentary cross-sectional profiles.

2. The combination of claim 1 wherein said side frame members curve intermediate upper and lower ends of said door frame.

3. The combination of claim 1 wherein said door is substantially planar between upper and lower ends of the door.

4. In combination with a sliding door, a latching and locking mechanism comprising:

an elongated handle pivotally mounted on the door, said handle including a latch member located along one edge of the handle, said latch member adapted to cooperate with a catch member fixed to a portion of an entranceway having a perimeter;

a key lock assembly mounted in said door and adapted to lock the door in a closed position by preventing disengagement of said latch member from said catch member; and upper and lower tracks mounted along upper and lower edges of the entranceway perimeter, and wherein rollers are mounted on inside surfaces at upper and lower end portions of the door, said rollers mounted for rolling movement in said upper and lower tracks.

5. The combination of claim 4 wherein said upper and lower tracks are substantially C-shaped, opening away from the entranceway, said rollers rotating about axes extending substantially perpendicular to said inside surfaces.

6. In combination with a sliding door, a latching and locking mechanism comprising:

an elongated handle pivotally mounted on the door, said handle including a latch member located along one edge of the handle, said latch member adapted to cooperate with a catch member fixed to a portion of an entranceway having a perimeter; and a key lock assembly mounted in said door and adapted to lock the door in a closed position by preventing disengagement of said latch member from said catch member; said key lock assembly including a rotatably key cylinder actuable by a key from outside the door, and a knob actuable form inside the door and configured so as to permit the door to be locked and unlocked from inside the door independently of the rotational position of the key cylinder;

wherein said key cylinder is operatively connected to a locking cam including a cylindrical bore which receives said key cylinder, said knob integrally formed with said locking cam and said locking cam being rotatable relative to said key cylinder through at least 90°, and further wherein rotation of said locking cam is resiliently controlled by a spring means engageable with said cylindrical portion of said locking cam.

7. The combination of claim 6 and wherein detents are provided on said cylindrical portion of said locking cam corresponding to locked and unlocked positions of said locking cam, and wherein said spring means is movable into and out of said detents upon rotation of said locking cam.

8. A sliding door construction for a cabin entranceway comprising:

a door including upper, lower and a pair of side edges;

a plurality of rollers mounted to inside surfaces of said door, adjacent said upper and lower edges, respectively; said plurality of rollers adapted for rolling engagement with upper and lower tracks secured along upper and lower portions, respectively of said entranceway;

a handle and lock assembly secured along one of said side edges of said door, said handle and lock assembly including a handle portion pivotally secured for movement between open and closed positions, said handle portion including an elongated latch member adapted to cooperate with an elongated catch member secured to the cabin entranceway; the handle and lock assembly further comprising a key lock mounted in said door adjacent said handle, said key lock including a key lock cylinder operatively associated with a locking cam for movement of said locking cam into and out of a slot provided in said handle from outside the cabin upon rotation of a key inserted within said key lock cylinder, and wherein said locking cam is rotatable from within the cabin into and out of said slot provided on said handle independent of the key lock cylinder position.

9. The sliding door construction of claim 8 wherein said key lock cylinder includes a key slot at one end, and a pair of radial projections on an end remote from said key slot, said radial projections adapted for reception within a recess provided within an open cylindrical portion of said locking cam, said recess permitting 90° freedom of rotation for said locking cam in opposite directions relative to said radial projections.

10. The sliding door construction of claim 8 wherein said elongated latch member is provided with a camming surface enabling said latch member to ride over said catch member upon closing of the door.

11. The sliding door construction of claim 10 wherein said handle is spring biased to a normally closed position.

12. The sliding door construction of claim 8 wherein said handle is pivotally secured within a cut-out portion along one of said side edges of said door.

13. The sliding door construction of claim 8 wherein said door curves intermediate said upper and lower edges.

14. The combination of claim 8 wherein said door includes two portions angularly arranged relative to one another.

15. The combination of claim 8 wherein said door lies substantially in a single plane between upper and lower edges.

16. The sliding door construction of claim 8 wherein said locking cam is provided with a manually grippable knob for facilitating rotation of said locking cam from within the cabin.

17. The combination of claim 8 and wherein rotation of said locking cam is resiliently controlled by a spring means engageable with said cylindrical portion of said locking cam.

18. The combination of claim 17 wherein detents are provided on said cylindrical portion of said locking cam corresponding to locked and unlocked positions of said locking cam, and wherein said spring means is movable into and out of said detents upon rotation of said locking cam.

* * * * *